United States Patent [19]

Heverly

[11] Patent Number: 4,531,794

[45] Date of Patent: Jul. 30, 1985

[54] ELECTRICAL OUTLET SAFETY FIXTURE

[76] Inventor: Karen H. Heverly, 894 Village Cir., Blue Bell, Pa. 19422

[21] Appl. No.: 574,380

[22] Filed: Jan. 27, 1984

[51] Int. Cl.[3] ..... H01R 13/44

[52] U.S. Cl. ..... 339/39; 339/125 R

[58] Field of Search ..... 339/36, 37, 39, 82, 339/122 R, 123, 125 R, 75 P

[56] References Cited

U.S. PATENT DOCUMENTS

| | | | |
|---|---|---|---|
| 2,510,745 | 6/1945 | Kilgore | 339/75 D |
| 2,738,475 | 3/1956 | Beach | 339/36 |
| 3,013,105 | 12/1961 | Craig | 339/36 |
| 3,491,327 | 1/1970 | Tait et al. | 339/36 |

*Primary Examiner*—Gil Weidenfeld
*Assistant Examiner*—Paula Austin
*Attorney, Agent, or Firm*—Ferrill and Logan

[57] ABSTRACT

A protective fixture which is detachably mounted to existing wall plug receptacles comprising: a base member which overlies the plug receptacle face plate; a retention pin adapted to affix the base member to the receptacle; four essentially flat walls extending outwardly from the periphery of the plate member, at least one pair of studs affixed diametrically across on the inside face of each of the base plate side wall surfaces, a cover member having two essentially flat sides spaced apart and held spaced apart by a third front side, the vertical edges of the cover flat sides will abut in close proximity to the outwardly projecting vertical edges of the side walls, at least one pair of latching elements affixed diametrially across on the edge of the inside face of each side wall of the cover member and adapted to fit and detachably lock with the adjacent studs, when the said cover member is slipped into cooperative union with the base member.

6 Claims, 7 Drawing Figures

ELECTRICAL OUTLET SAFETY FIXTURE

BACKGROUND OF THE INVENTION

This invention relates to wall-mounted electrical service outlets and is particularly directed to a protective housing for wall receptacles either while power plugs are connected or the outlets are exposed. The problem addressed here is the protection of incompetent persons from the injury due to accidental misuse of power receptacles. There is an especial need for protection of curious and crawling infants from electrical shocks, either from conductive tool insertion into the outlets or a manual contact with partially exposed plug prongs.

The concept of protecting persons from such outlet hazards is long recognized in the prior art. However, devices taught for protecting (blocking) are cumbersome to install or unduly complex to manufacture and thus unlikely to become economically attractive for residential household employment.

One early prior art structure requires a dual component cover securable to a special retainer plate installed under the regular receptacle face plate (U.S. Pat. No. 2,738,475, to Beach, March 1956). Another outlet cover involves a specially constructed cover box to slidably engage the regular receptacle box plate (U.S. Pat. No. 3,491,327 to Tait et al), or a special retainer wall plate to which the cover is demountably attached to by tension latches (U.S. Pat. No. 2,510,745 to Kilgore). Another even much more complex approach to the problem is the elaborate fixture assembly of U.S. Pat. No. 2,880,264 to Ruskin.

CROSS-REFERENCE TO RELATED APPLICATIONS

There are pending no related applications of this Applicant.

OBJECTS AND SUMMARY OF THE INVENTION

Figure 1:
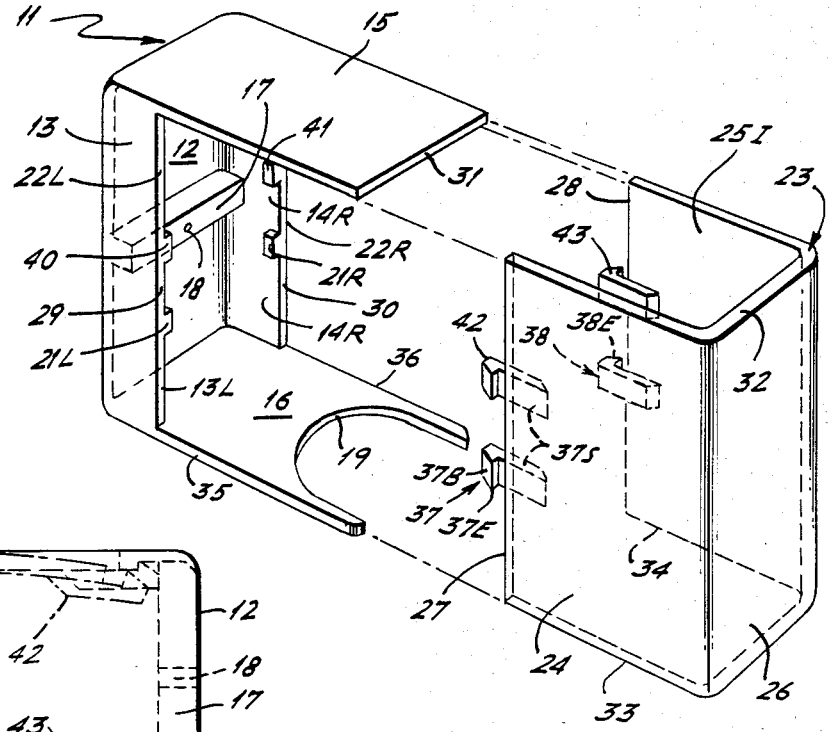
FIG. 1 is an exploded, perspective view of the protective fixture for electric outlet illustrating the features of this invention.
Figure 2:
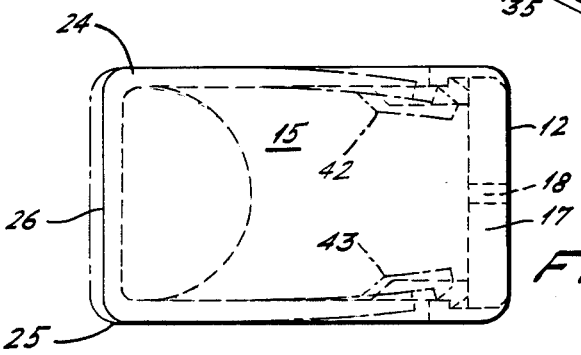
FIG. 2 is a top plan view, partially in phantom, of the assembled fixture with its cover and base plate positioned for use just prior to latching in safety position.
Figure 3:
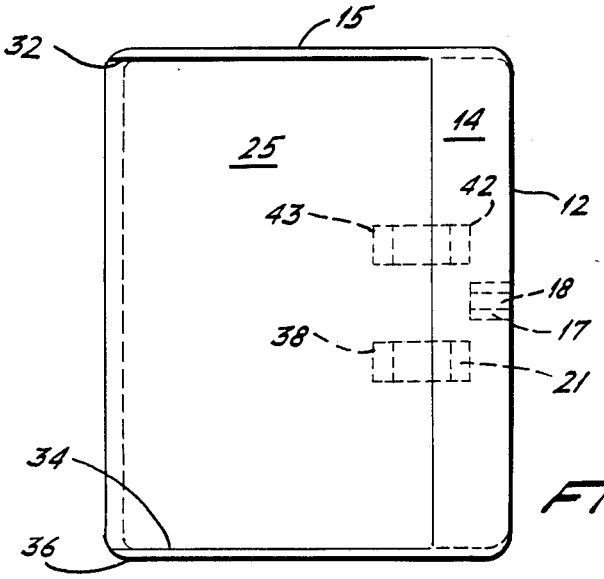
FIG. 3 is a right side plan view of the fixture with cover and base plate just prior to latching position.
Figure 4:
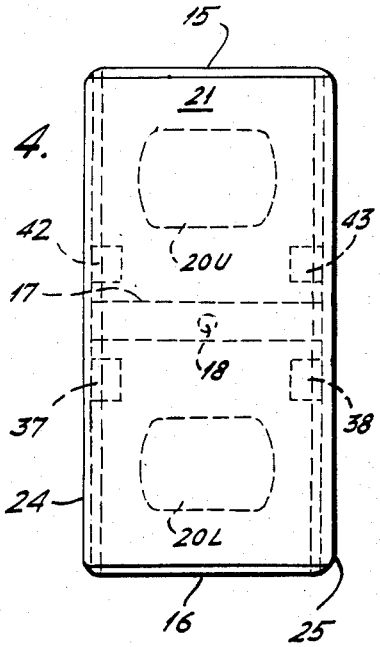
FIG. 4 is a front plan view of the assembled fixture.
Figure 5:
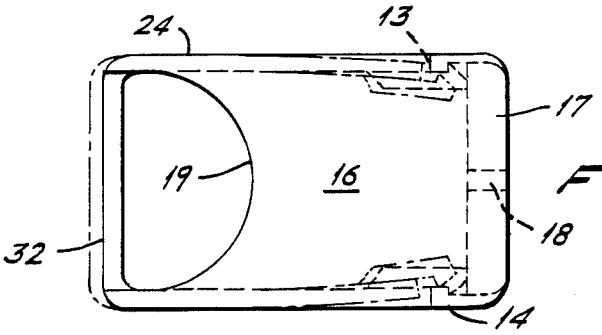
FIG. 5 is a bottom plan view, partially in phantom, of the fixture just prior to its reaching the latching position.

It is, therefore, an object of this invention to provide an electrical outlet protective fixture that is substantially inaccessible to an infant's tampering, readily accessible to adult manipulation, conveniently installed in existing wall outlets, and is configured against power line failing or visual damage.

It is a further object to provide a cover fixture for electric outlets which preclude incompetents from hazardous contact with the plug terminals.

Another object is to provide a safety fixture for electric outlets adapted to be installed by use of the single screw that also retains the conventional outlet face plate which the fixture will overlie.

Another object is to provide a safety device which is easy to initially install with a screw driver, and all subsequent mounting and detaching for plug access requires no hand tools.

Another object is to provide a safety shield attachable to any standard electrical outlet and with the cooperating power cord plug in place.

These and other objects are achieved by the provision of a protective fixture which is detachably mounted to existing wall plug receptacles comprising: a base member which overlies the plug receptacle face plate; a retention pin adapted to affix the base member to the receptacle; four essentially flat walls extending outwardly from the periphery of the plate member presenting two side walls, a longer top wall, and a longer bottom wall; an open portion provided in the bottom wall of sufficient size to permit the passage of at least one electrical plug power cord to connect with a plug which is mated with the receptacle; at least one pair of studs affixed diametrically across on the inside face of each of the base plate side wall surfaces and protruding inwardly of the opposing faces; a cover member having two essentially flat sides spaced apart and held spaced part by a third front side which is sized so that the vertical edges of the cover flat sides will abut in close proximity to the outwardly projecting vertical edges of the side walls of the plate member; at least one pair of latching elements affixed diametrically across on the edge of the inside face of each side wall of the cover member and extending partially beyond the said vertical edges of said member, said elements are adapted to fit and detachably lock with the adjacent studs, when the said cover member is slipped into cooperative union with the base member, so as to mesh the plug receptacles from digital access while in the assembled position overlying the receptacle.

In an alternate embodiment, the cover member is somewhat modified so as to be pivotally hinged on its upper surface to the base member.

Base plate 11 is preferably fabricated, perhaps by injection molding, from a thermosetting polymer, such as polystyrene, ABS resins, or the like. Contrariwise, the cover member 23 yet to be described, is fabricated of a somewhat resilient polymer, like a vinyl acetate or cellulose acetate, which will provide an important feature that is to be described.

DETAILED DESCRIPTION OF THE INVENTION

Generally, the illustrated fixture comprises a base member 11 with its periphery being configured to the usually rectangular shape of a conventional receptacle face plate (not seen) which it replaces when the invention is installed. Member 11 has a back wall 12 that masks most of the receptacle, four essentially flat walls outwardly extending from the back wall's periphery. That is, there are two vertical side walls 13 and 14, a long top wall 15, and a long bottom wall 16. Back wall 12 is provided with a horizontally disposed reinforcing rib 17 placed at a level which will match the screw recess (not seen). Rib 17 is also interposed between the sockets (not seen) of the receptacle normally found on the in wall receptacle itself. A central opening 18 is provided in rib 17 to receive a conventionally threaded screw (not seen) that normally affixes the now replaced face plate which is embedded in the wall or molding for the receptacle itself. The base member 11 is pinned to the receptacle by the screw when the fixture assembly is to be used. Above and below rib 17 are large openings 20 U and 20 L in back wall 12 sized to accommodate conventional power plugs (not shown).

An open portion 19 is provided in the outward edge of bottom wall 16. It may be arcuate, or box-like, as is most convenient in fabrication, so long as to be of sufficient size to permit the passage of at least one plug power cord (preferably two) to be connected to a plug mated to the receptacle outlet(s).

A first pair of studs 21 L and 21 R are affixed diametrically across from one another on the inside faces 13 L and 14 R, of each of side wall surfaces 13 and 14. They are intermediate the top and bottom walls 15 and 16. The studs are box-like inward protrusions terminating at the vertical edges 22 L and 22 R of walls 13 and 14, respectively, and extending backwardly to a point short of back wall 12.

The base member, which is generally rigid to support the cooperating cover 23, may be composed, of like, or dissimilar polymeric or metallic materials of construction, though metallic is not favored because it would not be an electrical insulator.

The vertical edges of the side walls are thusly provided with elements that will detachably interlock with associated elements on cover housing 23, as will be described.

Cover housing 23 is generally in the form of a rectangular box, with three sides being open ended.

Cover 23 has two essentially flat elongated vertical sides, 24 and 25, spaced from each other and held apart by a third front side 26. The depth of sides 24 and 25 is such that their respective leading edges, 27 and 28, will abut in close proximity to outwardly projecting vertical edges 29 and 30 of base member 11. Similarly, horizontal leading edge 31 on top wall 15 will close and overlap horizontal edge 32 of cover 23, while its bottom edges, 33 and 34, will slidably engage and overlap projecting edges 35 and 36 of lower wall 16. When assembled, the members form a closed side, protective fixture with only arcuate bottom opening 19 providing access for power cords through the safety shield.

A first pair of latching elements, 37 and 38, are affixed diametrically across from one another on the inside faces, 24 I and 25 I, on each of side wall surfaces 24 and 25. The pair are located intermediate the upper and lower edges of the side walls and at the same height as base studs, 21 L and 21 R, and extend partially beyond the vertical edges of said member. Each element has a shank portion, 37 S and 38 S, pinned to its respective inner wall surface, and an exterior portion 37 E and 38 E, generally projecting at right angles to the shank. They are oriented outwardly with a beveled leading edge, 37 B and 38 B, to slide past the opposing stud when the cover 23 is manually urged forward.

Because of the somewhat resilient nature of the material of cover 23, it can be flexed inwardly when each latch approaches the stud, until the complementary stud and latch elements lock the members in the closed position. Once mated, it would be necessary to manually compress inwardly the opposing side walls 24 and 25 of cover 23 in order to disengage the hooked elements, 37 E and 38 E, from engagement behind studs 21 L and 21 R.

While this mounting and demounting of the fixture is readily carried out by a purposeful adult, it is sufficiently intricate so that a curious infant should be unable to access the electrical outlets by inadvertence or tampering.

As an optional feature, a second pair of studs 40 and 41 and a cooperating pair of latches, 42 and 43, on cover 23, may be provided to gain a double latch in mating of the members.

It should further be noted that the base member 11 and cover member 23 are to be sized so that the linear distance between back surface 12 of the base and the bottom surface 16 is less than the lateral distance that would be required to pull a plug from an outlet, if there was not the protective fixture interposed over the plug receptacle.

Figure 6:
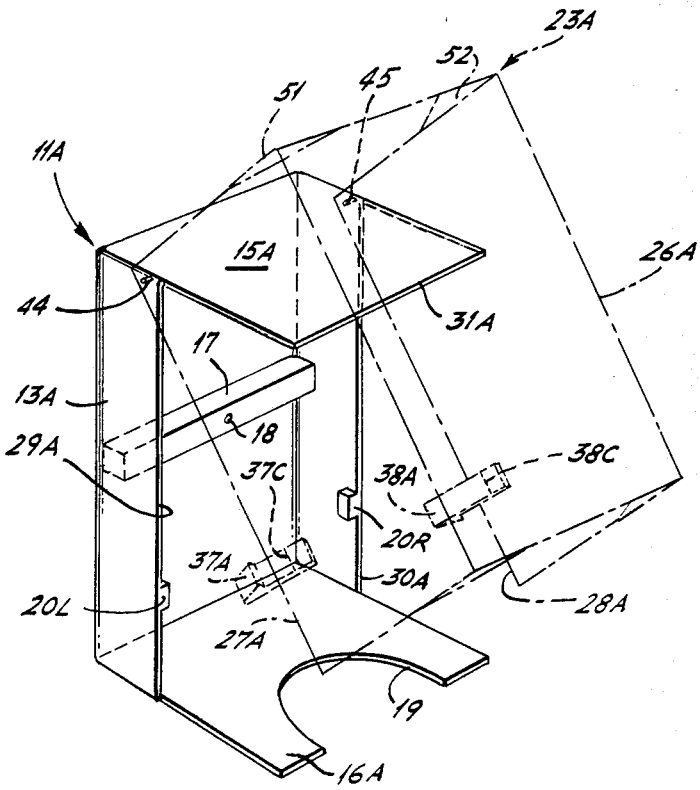
FIG. 6 is a perspective view of another embodiment of the present invention with its cover and base member in the hinged open (receptacle-access) position.
Figure 7:
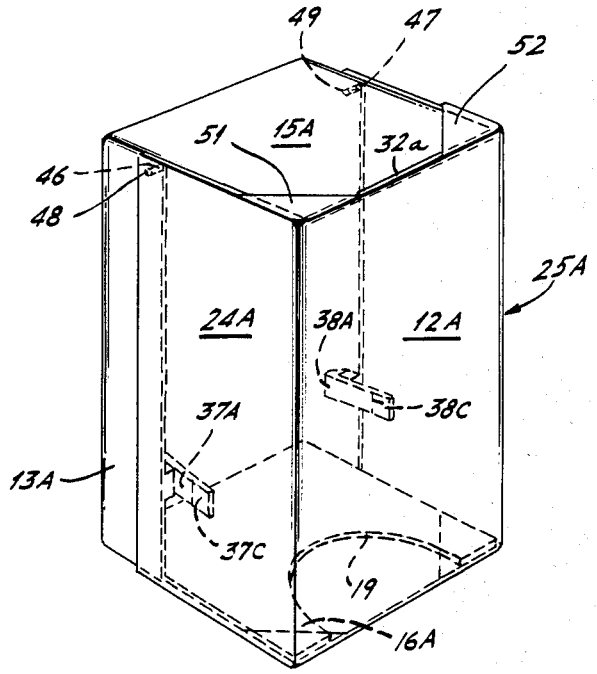
FIG. 7 is a perspective view of the embodiment of FIG. 6 in the latched position during use.

In an alternate embodiment, as seen in FIGS. 6 and 7, the cover 23 A is similarly configured, but it is pivotally hinged in its upper surface to base member 11 A, so that the two members are always an integral unit. The plug receptacles (not shown) are still readily accessed by pivoting of the cover member upwardly, as required, to reach a plug outlet.

Base member 11 A differs only in being provided with an opening, 44 and 45, respectively, on each side wall to receive fastening screws 46 and 47, much like the retention screw which affixes the base member over the plug receptacle. These openings are conveniently positioned in the upper section of the side walls 13 and 14, respectively, to permit upward tilting of the cover member.

Likewise, cover member 23 A is provided with an opening, 48 and 49, on each side wall, 24 A and 25 A, positioned in the rearward and upper quadrant of these cover sides so as to overlie the openings in the base side member walls. Once the member 11 A is pinned to the wall receptacle, then the cover 23 A may be permanently hinged by manually inserting the locking screws 46 and 47. The integral fixture is now in safety service.

In this embodiment a single pair of opposing studs, 20 L and 20 R, on leading edges 29 A and 30 A of member 11 A, and a single pair of opposing latches, 37 A and 38 A, on vertical edges 27 A and 28 A of member 23 A, should suffice, to retain the cover member in its locked position when it is pivoted downwardly till latching, after either inserting or pulling out of power cord plug (not seen). The sole initial disadvantage of this embodiment is the need to install three, rather than one, retainer screws before the fixture is operational.

Upper perimeter 32 A of cover member 23 A is provided with two triangular cover tabs, 51 and 52, in each outwardly facing cover. These serve to preclude infant fingers from prying back top wall 15A of the base member and thereby to access the receptacle face. Also, the triangle serves as a stiffener for the cover member 23 A, which is, by design, comprised of three open sides and is somewhat flexible to accommodate latching and release.

Again as to each of opposing latches, 37 A and 38 A, they should be cemented to the inside surfaces, 25 A and 26 A, only partially along their interface with those surfaces. For example, the cementing line 38 C could be at about half the distance of the overlap. This will facilitate the flex of the latch 38 A as it bends and slides by stud 20 R, concurrently while the side wall 25 A slips by outside and stops with a partial overlap of base side wall 14 A, as better seen in FIG. 7.

Numerous alterations of the structure herein disclosed will suggest themselves to those skilled in the art. However, it is to be understood that the present disclosure relates to preferred embodiments of my invention, which is for purposes of illustration only and not to be construed as a limitation of the invention. All such modifications which do not depart from the spirit of the invention are intended to be included without the scope of the appended claims.

What is claimed is:

1. An electrical wall outlet protective fixture which is detachably mountable to an existing electrical plug receptacle comprising:

(a) a rectangular back wall member configured to substantially overlie the plug receptacle;

(b) a retention pin adapted to affix said back wall member to said receptacle;

(c) four essentially flat walls extending outwardly from the periphery of said back wall member providing two opposing side walls, a top wall, extending outwardly from said back wall member a distance greater than said side walls and a bottom wall extending outwardly from said back wall member a distance greater than said side walls;

(d) an open portion provided in said bottom wall and of a sufficient size to permit the passage of at least one electrical plug power cord;

(e) at least one opening in said back wall member adapted to provide access to the receptacle sockets;

(f) at least one pair of studs affixed one each on each inside face of said side walls at a location across from one another and protruding towards one another;

(g) a separate cover member having two essentially flat sides spaced apart and held apart by a third front side sized so that the cover flat sides will abut in close proximity to the outwardly extending vertical edges of said side walls extending from said back wall member, and (h) at least one pair of latching elements affixed diametrically across on the edge of the inside face of each of said flat sides of the cover member and extending partially beyond thereof, said latching elements being adapted to fit and detachably lock with said paired studs, when the said cover member is slipped into cooperative union with said four flat walls extending outwardly from said back wall member.

2. The protective fixture of claim 1 wherein the linear distance between the inside surface of said back wall member and said open portion of said bottom wall is less than the lateral distance required to pull a plug from an outlet receptacle.

3. The fixture of claim 1 wherein said fixture has an external configuration approximating the plug receptacle to which it is mated.

4. The fixture of claim 1 wherein each latching element comprises a hook-like element comprising a shank portion and an exterior portion projecting outwardly from said shank portion and at a right angle thereto and an outer oriented beveled leading edge to permit sliding contact with a stud until said exterior portion slips past the stud to lock with same.

5. The fixture of claim 1 wherein said cover member is removable under manual compression of the cover member flat sides permitting the breaking of said cooperative union.

6. The fixture of claim 1 wherein said cover member is of a rigid but mildly deformable plastic material of construction.

* * * * *